US011268252B2

(12) United States Patent
Pastor et al.

(10) Patent No.: US 11,268,252 B2
(45) Date of Patent: Mar. 8, 2022

(54) METHOD FOR IMPROVING THE MECHANICAL AND HYDRAULIC CHARACTERISTICS OF SOILS

(71) Applicant: THUR S.R.L., Verona (IT)

(72) Inventors: Mariapia Pastor, Bosco Chiesanuova (IT); Andrea Birtele, Verona (IT)

(73) Assignee: THUR S.R.L., Verona (IT)

( * ) Notice: Subject to any disclaimer, the term of this patent is extended or adjusted under 35 U.S.C. 154(b) by 0 days.

(21) Appl. No.: 16/603,005

(22) PCT Filed: Apr. 5, 2018

(86) PCT No.: PCT/IB2018/052348

§ 371 (c)(1),
(2) Date: Oct. 4, 2019

(87) PCT Pub. No.: WO2018/185691

PCT Pub. Date: Oct. 11, 2018

(65) Prior Publication Data

US 2020/0190760 A1 Jun. 18, 2020

(30) Foreign Application Priority Data

Apr. 6, 2017 (IT) ..... IT102017000037754

(51) Int. Cl.
*E02D 3/12* (2006.01)
*E02D 5/54* (2006.01)

(52) U.S. Cl.
CPC ..... *E02D 3/12* (2013.01); *E02D 5/54* (2013.01)

(58) Field of Classification Search
CPC ..... E02D 3/12; E02D 5/801; E02D 2250/003; E02D 5/54
See application file for complete search history.

(56) References Cited

U.S. PATENT DOCUMENTS 4,832,535 A * 5/1989 Crambes ..... E02D 3/12 405/266
6,722,821 B1 * 4/2004 Perko ..... E02D 5/801 405/249
8,720,139 B2 * 5/2014 Henderson ..... E04C 5/125 52/295
10,138,641 B2 * 11/2018 Tabatabai ..... E02D 37/00
(Continued)

FOREIGN PATENT DOCUMENTS

EP 0851064 A1 7/1998
FR 2574442 A1 6/1986

OTHER PUBLICATIONS

International Search Report dated Jun. 21, 2018 re: Application No. PCT/IB2018/052348; pp. 1-3; citing: FR 2 574 442 A1.
(Continued)

*Primary Examiner* — Carib A Oquendo
(74) *Attorney, Agent, or Firm* — Cantor Colburn LLP

(57) ABSTRACT

A method for improving the mechanical and hydraulic characteristics of soils, including a step of providing tension members or nails which have an anchoring portion anchored in the soil to be improved and a second end portion fixed substantially at the surface of the soil to be improved; and a step of injecting cement mixtures or synthetic mixtures into the volume of soil to be improved below the surface.

The mixture injection step is performed after providing the tension members or nails.

14 Claims, 5 Drawing Sheets

(56) References Cited

U.S. PATENT DOCUMENTS

| | | | | |
|---|---|---|---|---|
| 2012/0009022 | A1* | 1/2012 | Meline | E21D 20/025 405/259.1 |
| 2013/0129423 | A1* | 5/2013 | Hakkinen | E02D 27/34 405/128.7 |
| 2017/0321552 | A1* | 11/2017 | Gustafsson | E21D 21/02 |
| 2018/0209113 | A1* | 7/2018 | Birtele | E04G 23/0211 |

OTHER PUBLICATIONS

IT Search Report dated Nov. 17, 2017 re: Application No. IT 2017000037754; pp. 1-6; citing: FR 2 574 442 A1.
Written Opinion dated Jun. 21, 2018 re: Application No. PCT/IB2018/052348; pp. 1-5; citing: FR 2 574 442 A1.

* cited by examiner

METHOD FOR IMPROVING THE MECHANICAL AND HYDRAULIC CHARACTERISTICS OF SOILS

TECHNICAL FIELD

The present disclosure relates to a method for improving the mechanical and hydraulic characteristics of soils.

BACKGROUND

Buildings and infrastructures in general transfer loads to the soil by means of foundation systems of different kinds and geometries, studied in order to optimize the spreading of tensions as a function of the mechanical characteristics of the soil.

The task of the geotechnical engineer is to study the aspects related to the soil and identify in the project the type of foundation that is most appropriate in order to contain the displacements and deformations of the building.

Sometimes the poor mechanical characteristics of the soil force the designer to consider solutions that are particularly onerous or even uncertain in their feasibility.

The design in this case requires a preliminary assessment aimed at considering preparatory interventions for improving the mechanical characteristics of the soil on which the building will stand, which allow to optimize costs for foundations and at the same time ensure the required safety factors in the soil-structure interaction.

There is also the case of existing buildings or infrastructures in which, for various reasons, mainly of a structural or geotechnical kind, problems occur after building which are linked to differential subsidences of the soil with consequent damage to the structures. In this case also, the designer can assess, in addition or as an alternative to interventions on the foundations aimed at improving the spreading of the tensions in the ground, soil consolidation work aimed at improving the mechanical characteristics of the bearing volume of the foundations.

Soil consolidation is therefore a field of geotechnical engineering which, thanks to the new technological possibilities offered by the industry, has increasingly often an important role not only in building or infrastructure designs but also in interventions for the extraordinary maintenance of existing buildings.

Among the various commercially available soil consolidation technologies there are compaction injections with cement mixtures or synthetic mixtures which do not fully penetrate within the intergranular voids but generate in depth volumes that are isolated therefrom and are capable, by virtue of the injection pressure that is used or by virtue of the pressure that is generated as a consequence of a chemical reaction of the mixture itself, of applying a stress to the underlying soil. The effect of this stress is the local increase in density of the surrounding soil and the subsequent rise of the ground level.

This last action, which is known as Compensation Grouting, sometimes desired together with the provision of surface tunnels in an urban area or with dewatering interventions which are preliminary to deep excavations below the water table, has the goal of reducing the impact of excavations on buildings on the surface.

However, lifting the building or the infrastructure is not always a goal for compaction injections. Sometimes the surface movement can generate unacceptable angular distortions for the surface structures or can even limit the compaction of the soil in depth, which might be greater in the presence of higher contrast loads.

An example of this is the method disclosed in EP0851064 which provides for an increase in the loadbearing capacity of foundation soils for buildings by means of the injection of a substance which expands as a consequence of a chemical reaction. In the described method, deep soil consolidation is checked by using laser receivers which are fixed to the structure that lies above the injected volume and which, connected to an emitter, report any slightest vertical displacement of the building as a consequence of the swelling of the substance in the soil and therefore report that the maximum possible consolidation for the soil has been reached as a consequence of the swelling of the expanding substance.

The method provides for the interruption of injection when the slightest vertical displacement of the building occurs. Therefore, differently from the Compensation Grouting method, the goal of the method disclosed in EP0851064 is to achieve the maximum possible consolidation of the foundation soil without producing significant displacements of the overlying building or soil.

There are also other soil consolidation methods which provide for the injection of mixtures of a different kind. Among these, mention is made of the Soilfrac technology used by the Keller Grundbau company, which provides for the use of cement mixtures which are also of the expanding type. The method provides for the creation, in multiple steps, of fractures in the soil on the part of the mixture injected by means of a pump which generates medium-high pressures. In this case also, the maximum consolidation achievable by injection is verified by means of an albeit minimal vertical displacement of the overlying building detected by means of level measurement systems which allow to view the relative motion of some points of the building with respect to others, utilizing the principle of communicating vessels.

In both of the described cases, the soil consolidation methods use systems for monitoring the overlying structures with the goal of identifying the effectiveness of the intervention, i.e., the achievement of the maximum possible consolidation of the soil by compaction.

Both of the described systems, however, have limitations which are linked essentially to the weight of the structure and of the covering soil. The compaction of the cement mixture or synthetic mixture in the soil is in fact tightly linked to the contrast offered by the covering soil and by the load of the overlying structure. Therefore, it is not possible to increase the level of compaction of the soil beyond the limit offered by the contrast of the covering soil and of the structure.

A method for providing piles or tension members is also known from FR2574442 in which, during the step for placing the tension member or nail, there is a step of mechanical compaction either by injection of grout or cement mixture, with the function of compacting the region around the tension member.

SUMMARY

The aim of the present disclosure is to solve the problems described above, by providing a method that is capable of increasing even just temporarily the contrast load and therefore of allowing the injection of cement mixture or synthetic mixture to perform a higher compaction than is possible in the presence of ordinary loads.

Within this aim, the present disclosure provides a method that is economical and simple and quick to perform.

This aim, as well as these and other advantages which will become better apparent hereinafter, are achieved by providing a method according to what is indicated in claim 1.

BRIEF DESCRIPTION OF THE DRAWINGS

Further characteristics and advantages of the present disclosure will become better apparent from the description of some preferred but not exclusive embodiments of the method according to the disclosure, illustrated only by way of nonlimiting example in the accompanying drawings, wherein.

DETAILED DESCRIPTION OF THE DRAWINGS

Figure 1:
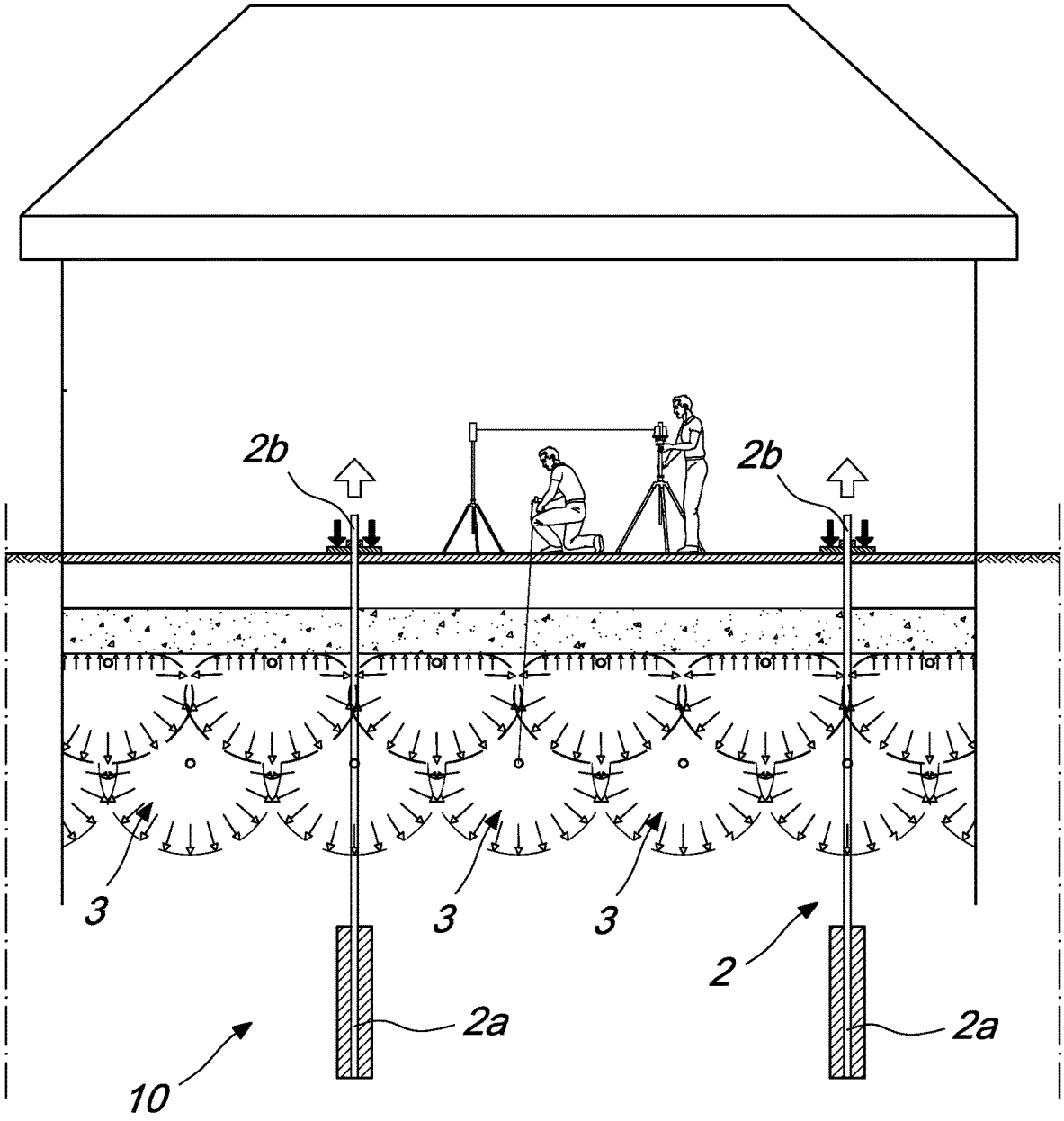
FIG. 1 is a schematic sectional view of a soil subjected to the method according to the disclosure.
Figure 2:
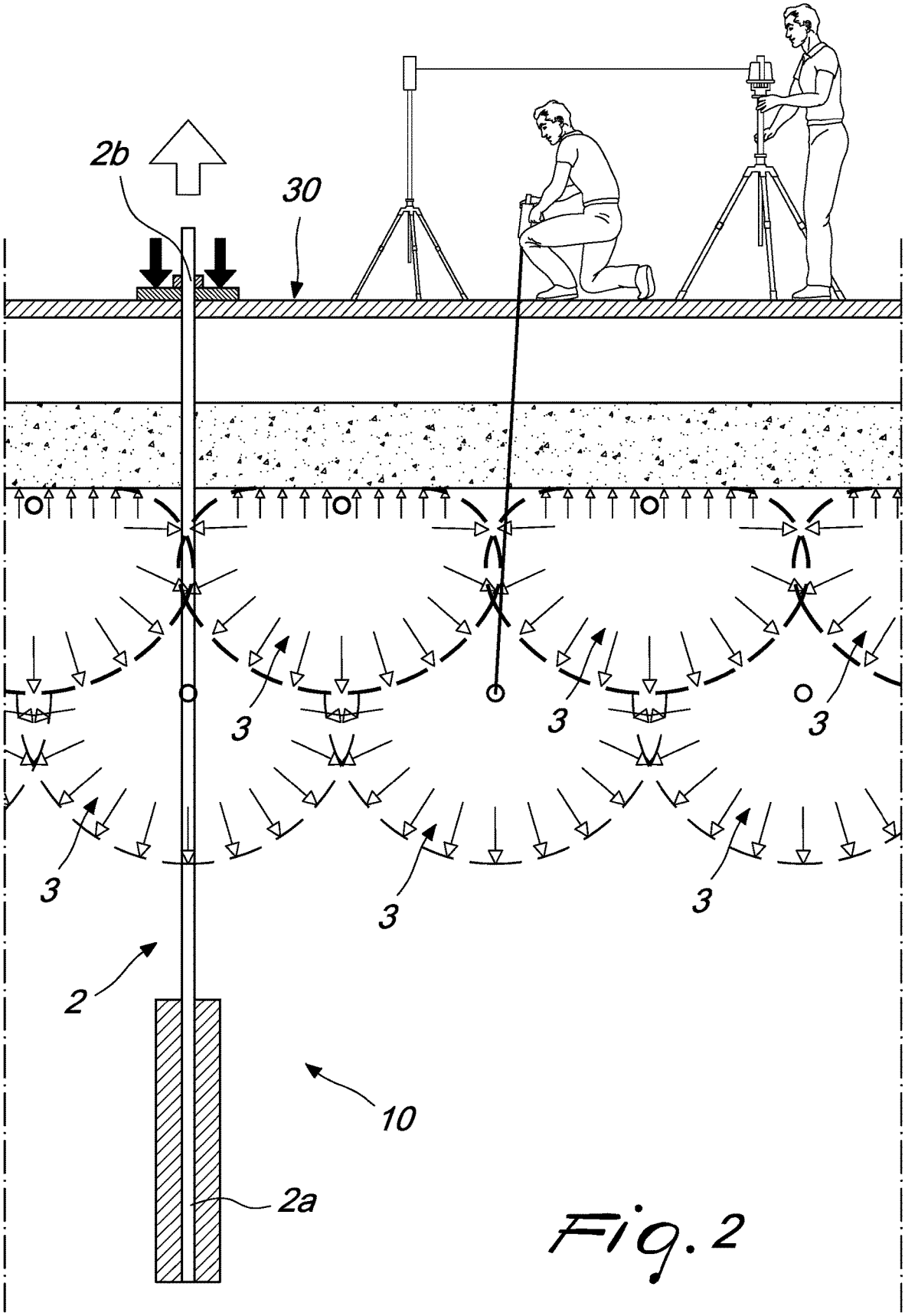
FIG. 2 is an enlarged-scale view of the schematic cross-section of FIG. 1.
Figure 3:
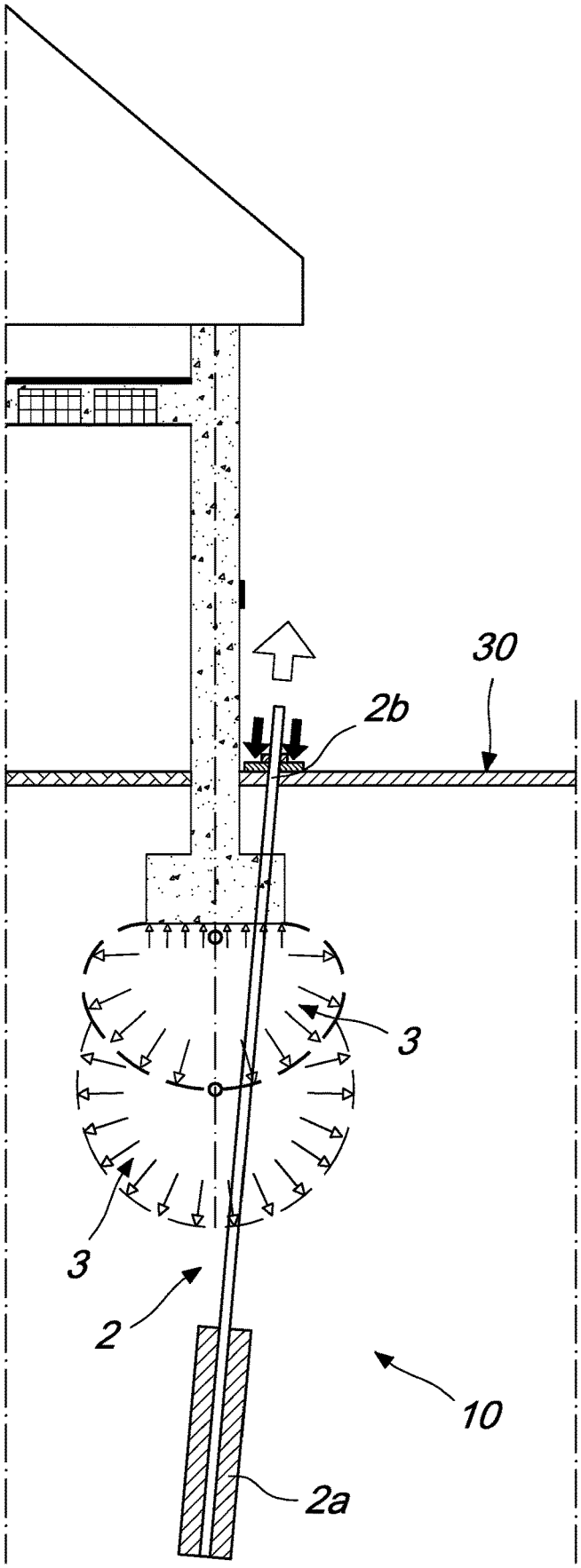
FIG. 3 is a sectional view of the soil subjected to the method according to the disclosure, taken along a vertical plane that is perpendicular to the sectional plane of FIG. 1.
Figure 5:
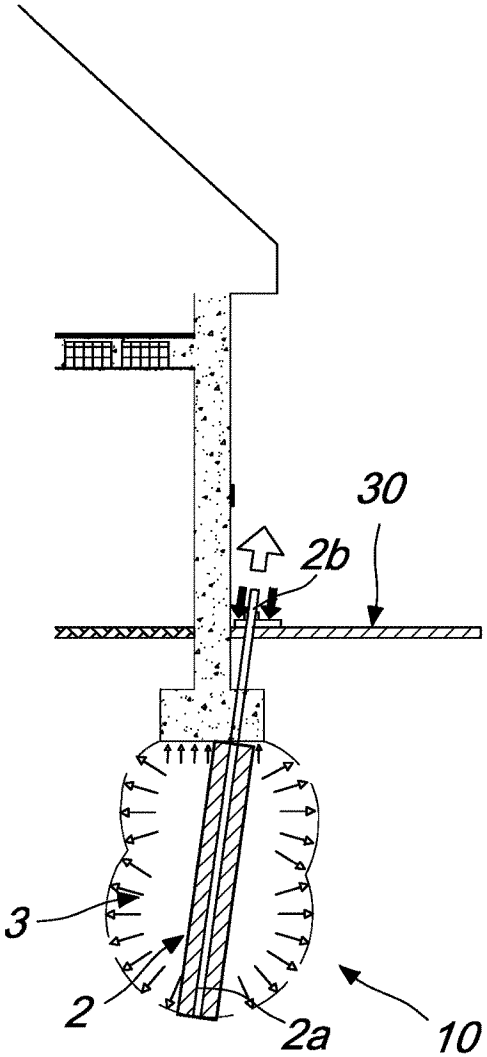
FIG. 5 is a sectional view of the soil subjected to the method according to the disclosure, taken along a vertical plane that is perpendicular to the sectional plane of FIG. 4.
Figure 4:
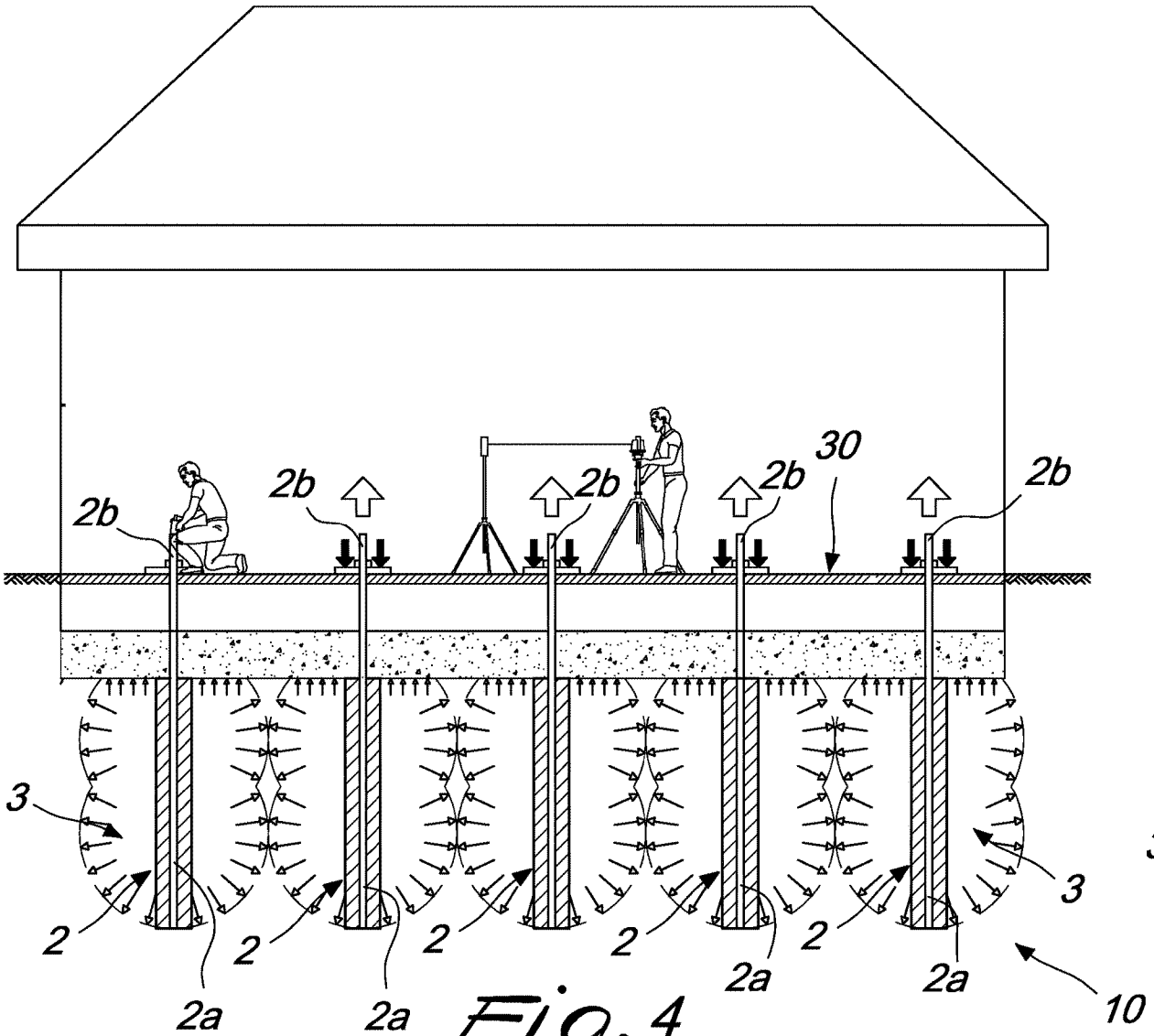
FIG. 4 is a schematic sectional view of a soil subjected to the method according to the disclosure during the step of providing the tension members according to an embodiment that is different from the one shown in FIGS. 1 to 3.
Figure 7:
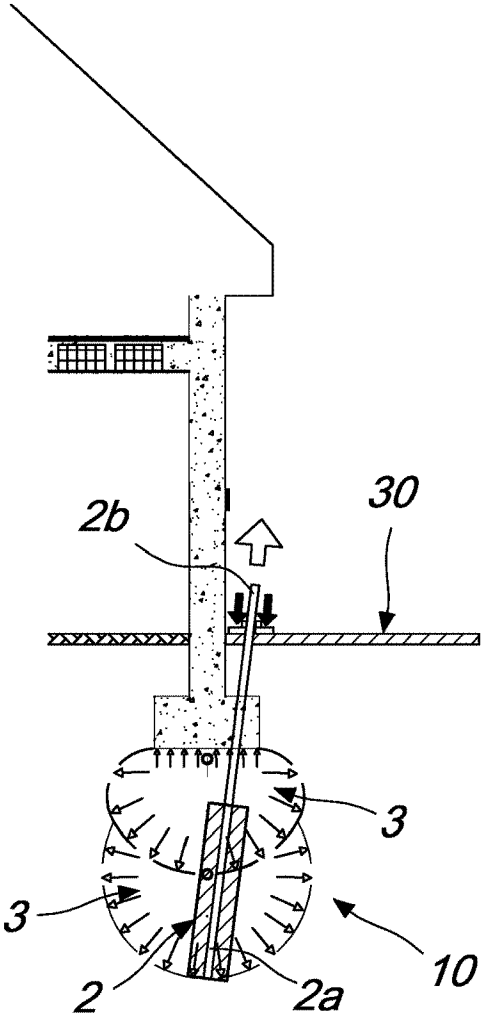
FIG. 7 is a sectional view of the soil subjected to the method according to the disclosure, taken along a vertical plane that is perpendicular to the sectional plane of FIG. 6.
Figure 6:
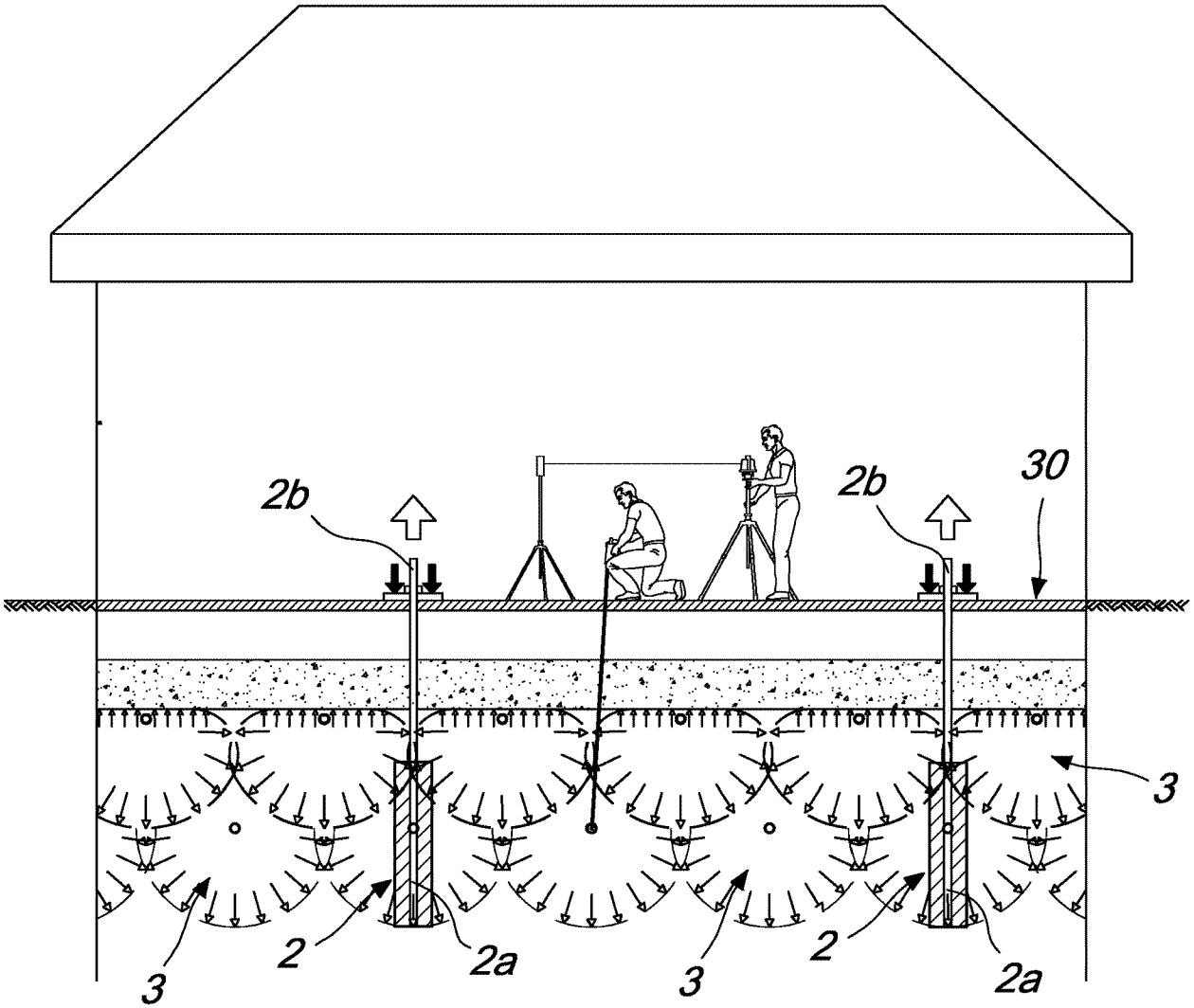
FIG. 6 is a schematic sectional view of a soil subjected to a process that is intermediate between the one shown in FIG. 1 and what is shown in FIG. 4, in which the injections are performed partly by independent cannulas and partly directly by the tension members by means of holes provided on their lateral surface.

With reference to FIGS. 1-7, the present disclosure relates to a method for improving the mechanical and hydraulic characteristics of soils by means of compaction injections.

In particular, the method according to the disclosure is adapted to increase the effectiveness of the operations for hydraulic and mechanical improvement of soils that can be obtained by means of injections of cement mixtures or synthetic mixtures.

The method according to the present disclosure comprises:

- a step of providing tension members or nails 2 which have an anchoring portion 2*a* anchored in the soil and a second portion 2*b* fixed substantially at the surface 30 of the soil to be improved 10;
- a step of injecting cement mixtures or synthetic mixtures 3 into the volume of soil to be improved 10 below the surface 30;

The step of injecting mixtures 3 is performed after the step of providing the tension members or nails 2.

In this manner, the injection step allows to improve the characteristics of the soil.

Advantageously, the step of injection of cement mixtures or synthetic mixtures 3 in the volume of soil to be improved 10 below the surface 30 is performed by means of independent cannulas (i.e., assigned exclusively to the injection of cement mixtures or synthetic mixtures 3) or by using the tension members 2 or the nails used to provide the tension members 2.

The step of providing the tension members 2 serves to increase the contrast beyond the limits offered by the weight of the building and of the covering soil so that the step of injecting mixtures 3 can achieve higher than ordinary soil compaction levels.

Conveniently, the anchoring portion 2*a* is formed at least at a first end of the tension members 2 or nails.

Nothing forbids said anchoring portion 2*a* from being extended for at least one part of the longitudinal extension of the tension members 2 or nails.

With reference to the practical embodiment shown in FIGS. 4 to 7, the anchoring portion 2*a* corresponds to the entire extension of the tension members 2 or nails inserted within the soil.

Preferably, the volume of soil to be improved 10 is extended at least partially above the anchoring portions 2*a*.

Specifically, the step of providing tension members or nails includes providing a plurality of holes which are vertical or inclined with respect to the vertical in the soil or also through the foundation of the existing building.

According to one possible practical embodiment, it is possible to provide, after said injection step, a step of separation of said second end portion 2*b* from the surface of the soil to be improved 10.

As an indication, the diameter of the holes is variable between 12 mm and 200 mm. The initial geometry with which the holes are distributed is determined by a computational model or, in the simplest cases, by experience. The center distance between the holes can vary from 0.30 m to 5.00 m as a function of the type of building. The depth of the holes is a function of the characteristics of the foundation soil and is independent of the depth and thickness of the soil to be improved 10.

Subsequently, hollow nails or tension members having a diameter comprised between 10 mm and 180 mm are accommodated in the holes and the cement mixtures or synthetic mixtures are injected into the soil through the nails or tension members or by means of auxiliary cannulas in order to create an adequate anchoring between the anchoring portion 2*a* of the tension member 2 or of the nail and the surrounding soil.

The anchoring portion 2*a* of the tension member 2 or of the nail can be arranged at a preset height and can have a length that can vary according to the requirements, even extending over the entire depth of the soil to be improved 10.

The nails or tension members are generally made of metallic, plastic or composite materials and have the form of solid bars, hollow bars, wires or strands.

The cement mixtures or synthetic mixtures are injected into the soil by using pressure pumping systems, which force the penetration of the cement mixtures or synthetic mixtures into the intergranular voids around the anchoring portion 2*a* of the nail or tension member or, in the presence of soils having a finer texture, produce the hydraulic fracturing of the soil that surrounds the anchoring portion 2*a* of the nail or tension member, i.e., the local breakup of the soil and the forming of lattices of mixture which, once hardened, improve the mechanical characteristics of the mass and provide maximum adhesion between the anchoring portion 2*a* of the nail or tension member and the surrounding soil.

If the anchoring portion 2*a* of the nail or of the tension member is extended to the entire depth of the soil to be treated, it is useful to provide openings on the corresponding part of the nail or tension member so as to allow the outflow of the mixture.

The pumping systems for the cement mixtures or synthetic mixtures deliver flow rates on the order of 5-30 liters per minute and usually generate pressures comprised between 2 and 100 bars. These pressures are capable of forcing the penetration of the cement mixture or synthetic mixture into the intergranular voids of sandy and gravelly soils and of allowing access of the cement mixture or synthetic mixture within silty or clayey soils by means of local fractures which are known in the technical jargon as hydraulic fractures.

If the cement mixtures or synthetic mixtures are of the expanding type, the penetration into the intergranular voids of coarse soils or the hydraulic fracturing of soils having a finer texture occurs also by virtue of the pressure that is generated during the expansion step, which usually occurs by chemical reaction, reaching values comprised between 0.5 bars and 150 bars.

The subsequent hardening of the mixture dispersed in the soil produces the improvement of the geotechnical characteristics and the maximum adhesion between the anchoring portion 2*a* of the nail or tension member and the surrounding soil.

As a consequence of the injection of the nail or tension member and after waiting for any hardening of the mixture, one proceeds with the fixing of the second end portion of the nail or tension member in the foundation of the structure arranged at the surface or, in the case of a free field, on the surface of the soil.

In the case of passive nails or tension members, fixing is performed directly following the curing of the injected cement mixture or synthetic mixture. In the case of active nails or tension members, fixing is performed after the curing of the cement mixture or synthetic mixture and after the tensioning of the upper end of the nail or tension member in order to create an adequate state of internal stress in the soil to be treated with the compaction injections.

Fixing is performed in the foundation itself of the surface structure by pouring or injecting cement mixtures or synthetic mixtures or is ensured by a mechanical system constituted by surface contrast plates, which, rested against the foundation or the soil, block, by means of wedge-shaped or screw elements or others, the lateral surface of the nail or tension member.

The tensioning action, if necessary, is pushed to traction values that can vary as a function of the requirements of the building site and are in any case comprised between 3 and 300% of the load of the existing or designed structure. The level of tensioning of the tension member must in any case avoid generating subsidences beyond the allowable extent of the foundations of the existing building.

The tensioning of the nail or tension member has the purpose of providing the foundation-soil system with a preset level of internal stress, i.e., a contrast value that is effective with respect to the subsequent compaction injection.

In this manner, the total contrast load exceeds immediately the ordinary value of the pressure offered by the structure and by the covering soil and allows to obtain much higher levels of compaction of the soil with respect to ordinary injections, also avoiding unwanted rises.

In the case of passive nails or tension members, the contrast exceeds the value of the ordinary pressure only following the first deformations of the nail or tension member and therefore as a consequence of a reduced vertical displacement of the structure or of the covering soil.

If a lifting of the structure or of the covering soil is desired, the passive nails or tension members can be tensioned only after the structure has experienced said lifting.

In this case, the fixing between the second end portion 2*b* of the nail or tension member and the respective abutment element can be provided by virtue of a mechanical system which allows the nail or tension member to travel along a certain extent before it blocks or can be provided after obtaining the desired lifting.

The subsequent step is not much different from the one of known methods.

A plurality of holes which are vertical or inclined with respect to the vertical is provided within the soil or also through the foundation of the existing structure, with a diameter that can vary from 12 mm to 200 mm. In this case also, the initial geometry with which the holes are distributed is determined by a computational model or, in the simplest cases, by experience. The center distance can vary from 0.30 m to 3.00 m as a function of the type of structure. The depth of said holes is a function of the geometry of the soil to be improved 10 and is advantageously lower than the depth of the anchoring portion 2*a* of the nail or tension member. Subsequently, tubes with a diameter comprised between 5 mm and 50 mm are accommodated in the holes and the synthetic mixtures or cement mixtures are injected into the soil to be improved 10 by means of low-pressure pumping systems. The penetration of the synthetic mixtures or resins into the soil to be improved 10 occurs by virtue of the pressure generated by the pump or of the pressure generated during the expansion step, which usually occurs due to a chemical reaction, reaching values comprised between 0.5 bars and 150 bars.

The subsequent hardening of the mixture distributed within the soil produces the improvement of the geotechnical characteristics.

In an alternative preferred embodiment, the injection step can be provided in the volume of soil to be improved 10 by using the same nails or tension members 2 on the shaft of which openings are provided beforehand which are adapted to allow the outflow of the cement mixtures or synthetic mixtures which are injected into the soil to be improved by means of pumping systems. In this case also, the penetration of the synthetic mixtures or synthetic resins into the soil to be improved occurs by virtue of the pressure generated by the pump and optionally also by virtue of the pressure generated during the expansion step of the mixture itself.

In all cases, the injection treatment produces a significant volumetric variation of the soil that surrounds the injection point, which accordingly generates displacements and deformations of the volumes of soil that are adjacent thereto and lie above it until it affects volumes which are immediately proximate to the resting of the foundations of the structure or to the surface soil are affected.

From this moment onward, the presence of nails or tension members is decisive, since it prevents significant displacements of the surface structure or of the surface soil even in the presence of actions of compaction of the soil on the part of the cement mixture or synthetic mixture that exceed ordinary contrast offered by the structure itself and/or by the covering soil.

Injection into the soil to be improved 10 is therefore extended beyond the ordinary, until the desired improvement of the hydraulic or mechanical characteristics is reported.

The improvement of the hydraulic or mechanical characteristics that is obtained can be checked by means of geotechnical tests on site, such as for example penetrometry tests or pressure gauge tests.

The quantity of mixtures to be injected can be determined by design, taking into account the additional contrast offered by the nails or tension members.

In the case of passive nails or tension members, the fixing between the second end portion 2*b* of the nail or tension member and the respective abutment element can be provided by means of a mechanical system which also includes an instrument for measuring the traction force to which the nail or tension member is subjected. In this case, the injection of cement mixture or synthetic mixture can be extended until this traction force reaches a predefined value.

Any movements of the structure or of the covering soil can be monitored for example by means of laser or radar systems. In this case, the injections of cement mixtures or synthetic mixtures can be interrupted when a displacement of said building or covering soil occurs. In extreme cases, the injections can be extended to the rupture of the nail or tension member, if the deformations of the structure or of the covering soil that thus occur are tolerable.

The method described by the present disclosure is used preferentially in cases of damage caused by phenomena of shrinkage and swelling of clayey soils as a consequence of variations of the level of humidity in the soil.

In these cases, the increase of the contrast load caused by the presence of nails or tension members allows to obtain, in addition to a higher than ordinary soil compaction level following the injection of cement mixtures or synthetic mixtures, an efficient contrast to the expansion of clayey soil, which can occur as a consequence of the increase in water content in the soil and can cause unwanted rises of the structures or of the surface soils. Moreover, the injection significantly reduces the overall permeability thereof, slowing significantly the addition of water into the consolidated soil volume and consequently mitigating the expansion of the clay.

In practice it has been found that the method according to the disclosure achieves fully the aim of improving the soil affected by compaction injections with pressure values that exceed the ordinary contrast offered by the structure and by the covering soil and, if necessary, preventing swelling phenomena of soils which are particularly sensitive to variations in water content cheaply, simply, rapidly, effectively and permanently.

The disclosure thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to the requirements and the state of the art.

The disclosures in Italian Patent Application no. 102017000037754, from which this application claims priority, are incorporated herein by reference.

The invention claimed is:

1. A method for improving the mechanical and hydraulic characteristics of soils, the method including the following steps:

providing tension members or nails including anchoring an anchoring portion of said tension members or nails in soil to be improved and including fixing a second end portion of said tension members or nails substantially at a surface of soil to be improved, and injecting cement mixtures or synthetic mixtures into a volume of soil to be improved below said surface using cannulas that are independent from said tension members, wherein cannulas are arranged separately and distally from said tension members, said mixture injection step being performed after providing said tension members or nails.

2. The method according to claim 1, wherein said anchoring portion is formed at least at a first end, which lies opposite said second end portion of said tension members or nails.

3. The method according to claim 1, wherein said anchoring portion is extended along at least one part of the longitudinal extension of said tension members or nails.

4. The method according to claim 1, wherein said anchoring portion substantially corresponds to the entire extension of the tension members or nails inserted in soil.

5. The method according to claim 1, wherein the volume of soil to be improved is extended at least partially above said anchoring portions.

6. The method according to claim 1, further comprising, after said injection step, a step of separating said second end portion of said tension members or nails from the surface of the soil to be improved.

7. The method according to claim 1, wherein during said step of providing tension members or nails, said second end portion is fixed substantially at at least one rigid abutment element.

8. The method according to claim 7, wherein said rigid abutment element comprises a surface portion of a built structure.

9. The method according to claim 8, further including a step for monitoring the vertical movements of said built structure or of said surface soil, a step of interrupting said injection step upon the detection of a vertical displacement of said built structure or of said surface soil being provided.

10. The method according to claim 7, wherein said rigid abutment element comprises a surface contrast plate.

11. The method according to claim 7, wherein said fixing between said second end portion and the respective rigid abutment element is performed by pouring or injecting cement mixtures or synthetic mixtures or by means of the interposition of an interconnection device.

12. The method according to claim 7, wherein the fixing between the end portion of the nail or tension member and the respective abutment element is provided by means of a mechanical system which includes an instrument for measuring a traction force to which the nail or tension member is subjected, there being a step for interrupting said injection step upon the detection of a predetermined traction force value.

13. The method according to claim 1, further including a step for tensioning said tension members or nails.

14. The method according to claim 13, wherein a step for interrupting said injection step following breakage of said tension members or nails is provided.

* * * * *